US006957836B1

(12) United States Patent
Briley et al.

(10) Patent No.: US 6,957,836 B1
(45) Date of Patent: Oct. 25, 2005

(54) LOCK ASSEMBLY

(75) Inventors: William P. Briley, Tybee Island, GA (US); George T. Croft, Bluffton, SC (US); Robert E. Schmeck, Ocala, FL (US)

(73) Assignee: Tactile Lock, Inc., Bluffton, SC (US)

( * ) Notice: Subject to any disclaimer, the term of this patent is extended or adjusted under 35 U.S.C. 154(b) by 0 days.

(21) Appl. No.: 10/919,536

(22) Filed: Aug. 17, 2004

(51) Int. Cl.[7] ..... E05C 19/10

(52) U.S. Cl. ..... 292/129; 292/137; 292/179; 70/365

(58) Field of Search ..... 292/129, 137, 292/177–180, 165, 169, 169.18, 170, DIG. 37; 70/365, 366, 495, 496, DIG. 20

(56) References Cited

U.S. PATENT DOCUMENTS

| | | | | | |
|---|---|---|---|---|---|
| 1,154,439 | A | * | 9/1915 | Scholfield et al. | 292/144 |
| 1,165,542 | A | * | 12/1915 | Schnerre | 70/282 |
| 1,705,706 | A | * | 3/1929 | Bartholomew | 292/166 |
| 2,264,182 | A | * | 11/1941 | Miller | 292/340 |
| 2,828,151 | A | * | 3/1958 | Brotman et al. | 292/144 |
| 3,017,761 | A | * | 1/1962 | Pleterski | 70/133 |
| 3,605,459 | A | * | 9/1971 | van Dalen | 70/144 |
| 3,751,086 | A | * | 8/1973 | Geringer | 292/144 |
| 3,890,814 | A | * | 6/1975 | Fantoni | 70/106 |
| 4,058,992 | A | * | 11/1977 | Nielsen, Jr. | 70/34 |
| 4,691,948 | A | * | 9/1987 | Austin et al. | 292/171 |
| 4,813,251 | A | * | 3/1989 | Fowler et al. | 70/116 |
| 4,993,247 | A | * | 2/1991 | Minemura | 70/208 |
| 5,004,287 | A | * | 4/1991 | Doyle | 296/57.1 |
| 5,044,678 | A | * | 9/1991 | Detweiler | 292/144 |
| 5,239,767 | A | * | 8/1993 | Briley et al. | 42/70.11 |
| 5,475,994 | A | * | 12/1995 | Briley et al. | 70/34 |
| 5,517,837 | A | * | 5/1996 | Wang | 70/226 |
| 5,916,279 | A | * | 6/1999 | Shieh | 70/33 |
| 6,553,793 | B1 | * | 4/2003 | Chen | 70/33 |
| 6,604,313 | B1 | * | 8/2003 | Kress | 42/70.11 |
| 6,701,655 | B2 | * | 3/2004 | Milo | 42/70.11 |

* cited by examiner

*Primary Examiner*—Daniel P. Stodola
*Assistant Examiner*—Carlos Lugo
(74) *Attorney, Agent, or Firm*—Roger M. Rathbun

(57) ABSTRACT

A lock assembly having a housing containing a push rod movable along its longitudinal axis between a locked position where the push rod is extended outwardly of the housing and a retracted, unlocked position. A movable latch moves radially to engage with the push rod to hold it in the locked position and to disengage from the push rod to allow the push rod to move to its unlocked position. The latch member has an opening that, when aligned with the main axis of the push rod, allows the push rod to pass through the opening but when the latch member is offset with respect to that axis the latch member abuts against the push rod to prevent the push rod from moving to its unlocked position. A pushbutton moves the latch member and a locking assembly blocks the movement of the pushbutton when the lock assembly is locked.

19 Claims, 12 Drawing Sheets

LOCK ASSEMBLY

FIELD OF THE INVENTION

The present invention relates generally to the field of locks and, more particularly, to a secure lock assembly that is economical to produce and which has a keyless, numberless but tactile positive locking and unlocking action.

BACKGROUND OF THE INVENTION

There are, of course, many differing types of locks that are currently available on the market. There are a number of design criteria for locks in general, that is, the lock must certainly be sufficiently rugged so as to withstand tampering or the attempt by someone to thwart the integrity of the lock to gain entry to the locked premises. Typically, with conventional padlocks, the padlock is a prime target for the insertion of a prybar intermediate the lock body and the curved movable component to attempt to defeat the purpose of the lock. Alternatively, the hardware securing the padlock to the secured premises is also a target for a prybar such that the hardware itself can be removed or broken and the padlock left in tact.

Accordingly, not only is it important that the lock be sufficiently rugged so as to withstand attempts at its breakage but it would also be advantageous for the lock to be designed so as to minimize points of entry of a prybar or other device that could be used to gain leverage in order to defeat the purpose of the lock.

Furthermore, it is important to provide a means for the locking and safeguard of material for those individuals who are blind or who are visually impaired. As such, it would be advantageous to have a locking device that is tactile in nature and provides service for such persons as well as provide a means to secure and open a lock with limited lighting or in the dark.

Additionally, it is also important for commercial locks to be manufacturable at a low cost so as to be competitive in the marketplace and, therefore it would be advantageous for such locks to take advantage, to the extent possible, of the use of relatively inexpensive, mass produced, molded components constructed of high impact plastic materials in order to gain the advantage of producing a low cost lock which is also rugged in accordance with the prior criteria. Thus, the advantage of a low cost lock can be achieved without sacrificing the integrity of the lock by the design of a lock that can utilize certain molded plastic components in its construction.

As a further criteria of locks, albeit not as important as the prior described criteria, it is advantageous for the lock to have a good appearance so as to be esthetically pleasing within the particular environment where it is being used, including the interior of a home or dwelling place so that the lock does not detract from the overall appearance or decor of the living quarters.

As such, it would be advantageous to have a lock assembly that is sufficiently rugged so as to withstand attempts at tampering, economical to produce by taking advantage of certain easy to mass-produce plastic materials, and yet have a esthetically pleasing overall appearance.

SUMMARY OF THE INVENTION

The present invention relates to a lock assembly that provides the advantages and meets the aforementioned criteria and includes a housing that contains the various lock components. Located within the housing is a pushrod that has a longitudinal axis and the push rod is movably affixed within the housing to move along its longitudinal axis.

A distal end of the pushrod passes through an opening in the housing and moves along that longitudinal axis between a locked position wherein the distal end of the push rod extends outwardly from the housing and an unlocked position wherein the push rod is retracted inwardly toward the housing from the fully extended, locked position. As will be seen, the distal end of the push rod, when extended to its locked position, can engage other hardware in order to secure the particular item or premises that is being locked. The push rod is biased toward its unlocked, retracted position by means such as a spring located within the housing.

The push rod has a ridge formed on a peripheral surface thereof and, in one embodiment, the cross section of the push rod is circular and the ridge is formed as a circular collar that extends outwardly to form an annular surface or circumferential ridge on the push rod. As an alternative, the ridge can be formed as a groove that encircles the peripheral surface of the push rod and one inner surface of the grove acts as an annular surface to serve a purpose to be later explained in carrying out the present invention.

The present lock assembly also includes a latch member that is located within the housing and which is movable in a radial direction with respect to the longitudinal axis of the push rod. The latch member has an opening that is preferable configured to be in the same general shape as the ridge formed on the peripheral surface of the push rod and that opening is larger than the ridge such that the push rod, including the ridge can pass through the opening in the latch member when the opening and the ridge are in alignment with each other. When the opening in the latch member is offset or misaligned with the ridge, that is, the latch member has been moved radially out of such alignment, the peripheral edge of the opening engages against the surface of the ridge to hold the push rod in its extended, locked position. The latch member is biased toward its misaligned or offset position.

As such, the push rod can be moved to its locked position and, at that locked position, the ridge is in radial alignment with the latch member and the latch member is biased to move radially to misalign with the ridge and hold the push rod in that extended, locked position. When it is desired to move the push rod to its retracted, unlocked position, the user can simply displace the latch member from its misaligned or offset position to its aligned position where the opening in the latch member is in alignment with the ridge, whereupon the opening being slightly larger than the ridge, allows the ridge to pass through the opening and the bias thereby moves the push rod to its retracted unlocked position.

There is also a release mechanism that is employed to carry out the movement of the latch member to move it between the aligned and misaligned positions. The release mechanism includes a T-bar located within the housing and extending generally along an axis parallel to the longitudinal axis of the push rod. The T-bar can contact the latch member and thus, movement of the T-bar radially with respect to the longitudinal axis of the push rod will move the latch member from its misaligned position its aligned position; the return to the misaligned position being activated by the bias on the latch member toward that misaligned position.

The release mechanism can also include a movable push button that is affixed to the housing and which extends external of the housing so as to be assessable to a user who can push the pushbutton to move the latch member to its aligned position to allow the push rod to move to its retracted, unlocked position. Simply put, the user can push the push button that is activatable external of the housing to cause the push rod to spring from its extended, locked position to its retracted, unlocked position. To move the push rod back to the locked position, the push rod is simply pushed by the user to its extended, locked position whereupon the latch member will spring back into its misaligned position to seat against the ridge to retain the push rod in that extended locked position.

Lastly, there is a locking assembly that alternatively allows, or blocks the inward radial movement of the T-bar such that the locking assembly can allow the push button to effectively move the T-bar or the locking assembly can physically block the movement of the T-bar such that the pushbutton cannot move the T-bar, or, for that matter, the latch member. According, by the activation of the locking assembly, the pushbutton can, or cannot, be operated to cause the push rod to move to its retracted, unlocked position.

The locking assembly is constructed in accordance with the assembly shown and described in U.S. Pat. Nos. 4,475,99 and 5,239,767 of Briley Jr. et al and the disclosures of those patents are hereby incorporated herein in their entirety by reference.

In essence, the locking assembly of the aforedescribed Briley Jr. et al patents includes a plurality of lock tumblers each having a notch formed at a location about their peripheral edges. By the use of a tactile or feel mechanism, the various lock tumblers are manipulated until the user, upon entering the correct sequence of rotational movements, aligns all of the notches with respect to each other, thereby enabling the lock to be opened.

As used in the present invention, when the rotational sequence lock tumblers of the locking assembly of Briley Jr. et al has been properly entered, and all of the notches on those lock tumblers are in alignment, the T-bar can enter into all of the aligned notches so that it can be moved radially inwardly toward the push rod, that is, the inward radial movement of the T-bar is blocked by one or more of the tumblers unless all of the notches of the lock tumblers are in the proper decoded alignment. When that has been achieved, and only then, the pushbutton can be activated to move the T-bar radially inward to also move the latch member to its aligned position to, in turn, allow the push rod to snap into its unlocked position by the bias acting against the push rod.

Accordingly, the present lock assembly is easily locked and it is just as easily unlocked once the secure rotational sequence has been entered by the user but the lock is very secure and rugged and has no easy access area where a tool such as a prybar could be effectively employed in an attempt to thwart its purpose. The individual components can be economically constructed of molded high impact, plastic materials and the assembly and cost of those components relatively inexpensive. Finally, the appearance of the lock assembly presents a pleasing, streamlined look that is acceptable in all environments. Also, due to the tactile nature, the lock can be used by blind or visually impaired persons or in areas of dim or no lighting.

As another feature of the present lock assembly, there are a number of associated hardware components and combinations that can be used that enable the lock assembly to be used in various illustrative, but not limiting, differing situations. For example, the lock assembly can be used to move a plurality of oppositely disposed cross rods to spread the cross rods away from each other; the lock assembly can be used to secure a pivoting door or gate and the lock assembly can be used to secure a pliable member such as a cable.

In summary, the present device locks a linear actuator or push rod in an extended position. The linear actuator or push rod is retracted after the keyless lock combination is entered. Such a device leads to new ways to build high security gate locks, draw locks, auto and boat ignition locks, bicycle chain locks and keyless interior and exterior door locks. Since the lock is keyless and tactile, the security of the devices utilizing the lock are significantly increased. In addition the conventional hasp and pad lock system leaves lock parts exposed, thereby making it easy to defeat the lock with cutting tools and crowbars. Use of a linear actuator controlled by a keyless lock system circumvents the obvious methods used to defeat conventional pad lock systems.

These and other features and advantages of the present invention will become more readily apparent during the following detailed description taken in conjunction with the drawings herein.

DETAILED DESCRIPTION OF THE INVENTION

Figure 1:
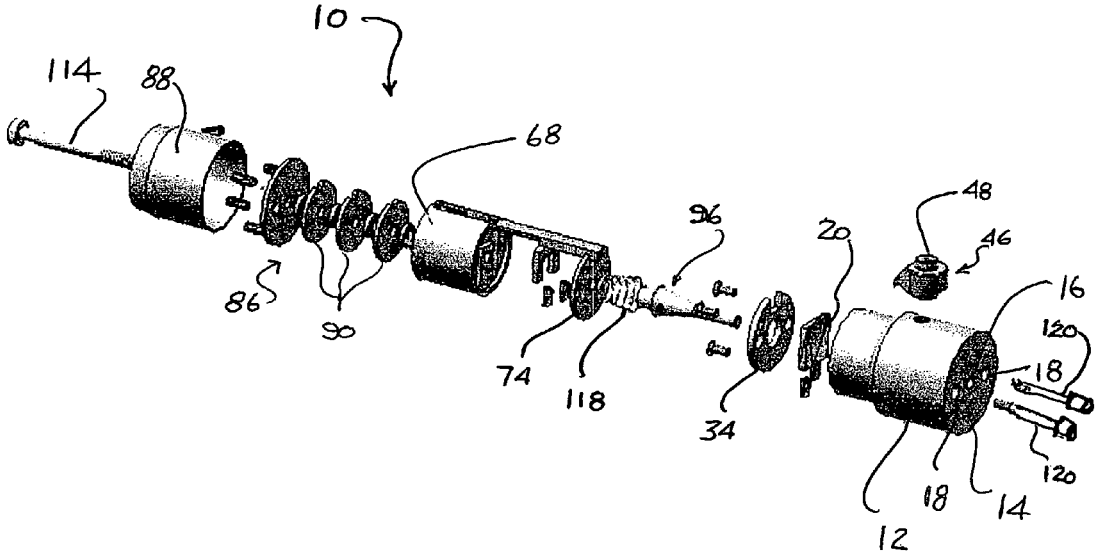
FIG. 1 is an exploded view of the present lock assembly to illustrate its assembly and its individual components.

Referring now to FIG. 1, there is shown a perspective view of a lock assembly 10 constructed in accordance with the present invention. As can be seen, the lock assembly 10 includes a housing 12 that may be cylindrical in configuration and has a front face 14 having a plurality of openings formed in the housing 12, that is, there is a central opening 16 and a pair of lateral openings 18 and the purpose of those openings will later become clear.

Figure 2:
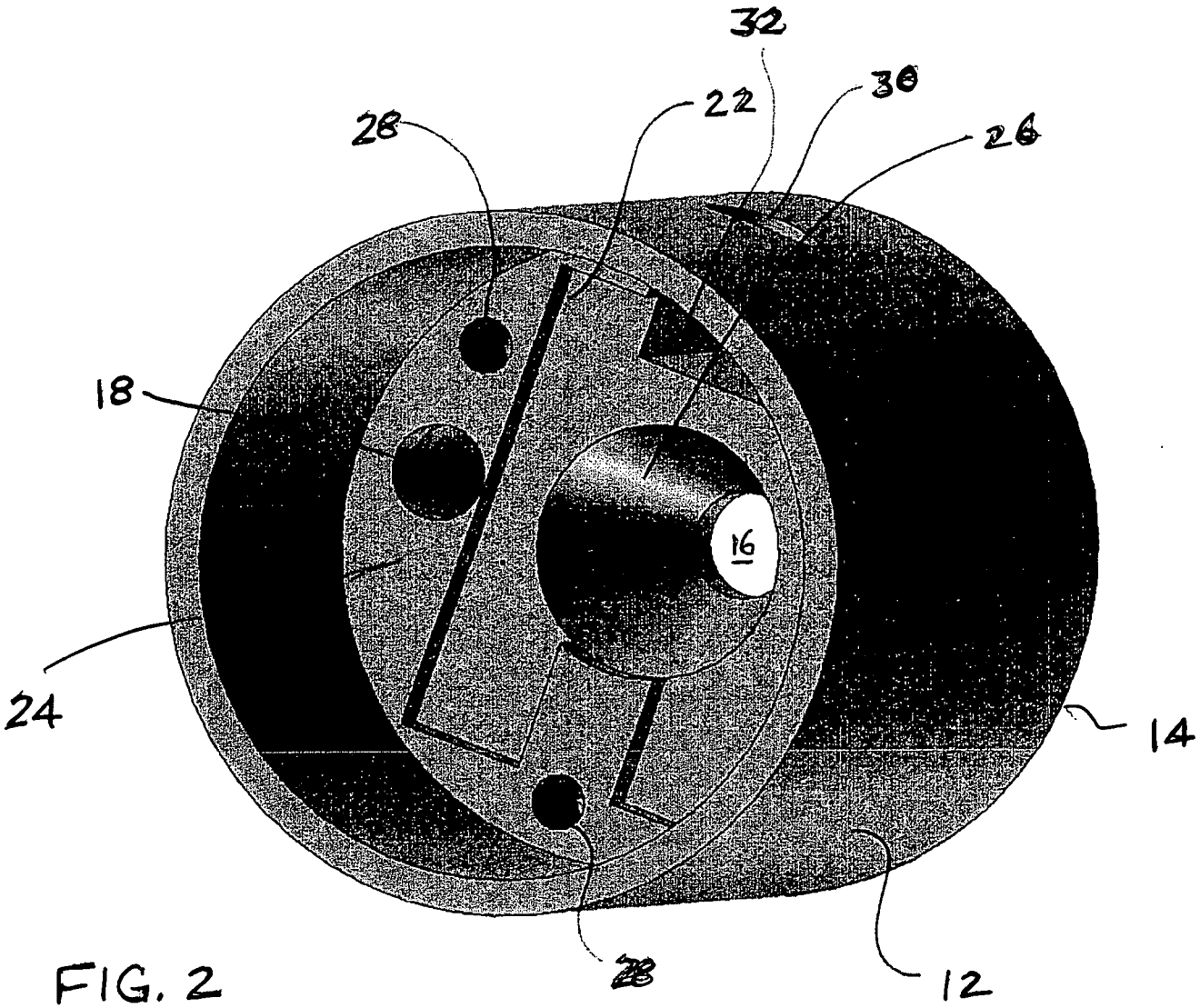
FIG. 2 is a perspective view showing the internal area of the housing of the present invention.

A latch member 20 is slidingly affixed within the housing 12. Turning briefly to FIG. 2, taken along with FIG. 1, there is shown a perspective view illustrating the interior of the housing 12 in order to show the affixation of the latch member 20 to that housing 12. As can be seen in FIG. 2, there is a recess 22 formed in the interior surface 24 of housing 12 that is generally configured to be complementary to the outer shape of the latch member 20 such that the latch member 20 can nestle within the recess 22. There can also be seen in FIG. 2, the central opening 16 and which can be seen to be the terminus of a conical shape bore 26 having a central axis and that conical shaped bore 26 narrows in the direction toward the front face 14 of the housing 12.

In FIG. 2 there is also shown one of the lateral openings 18 and threaded holes 28, of which two are shown and there are three threaded holes 28 formed in the interior of housing 12 in the illustrated embodiment. Other features of the housing 12 include a hole 30 in the wall of the housing 12 and which provides an entrance leading to a generally rectangular recess 32 in the interior of the housing 12.

Figure 3:
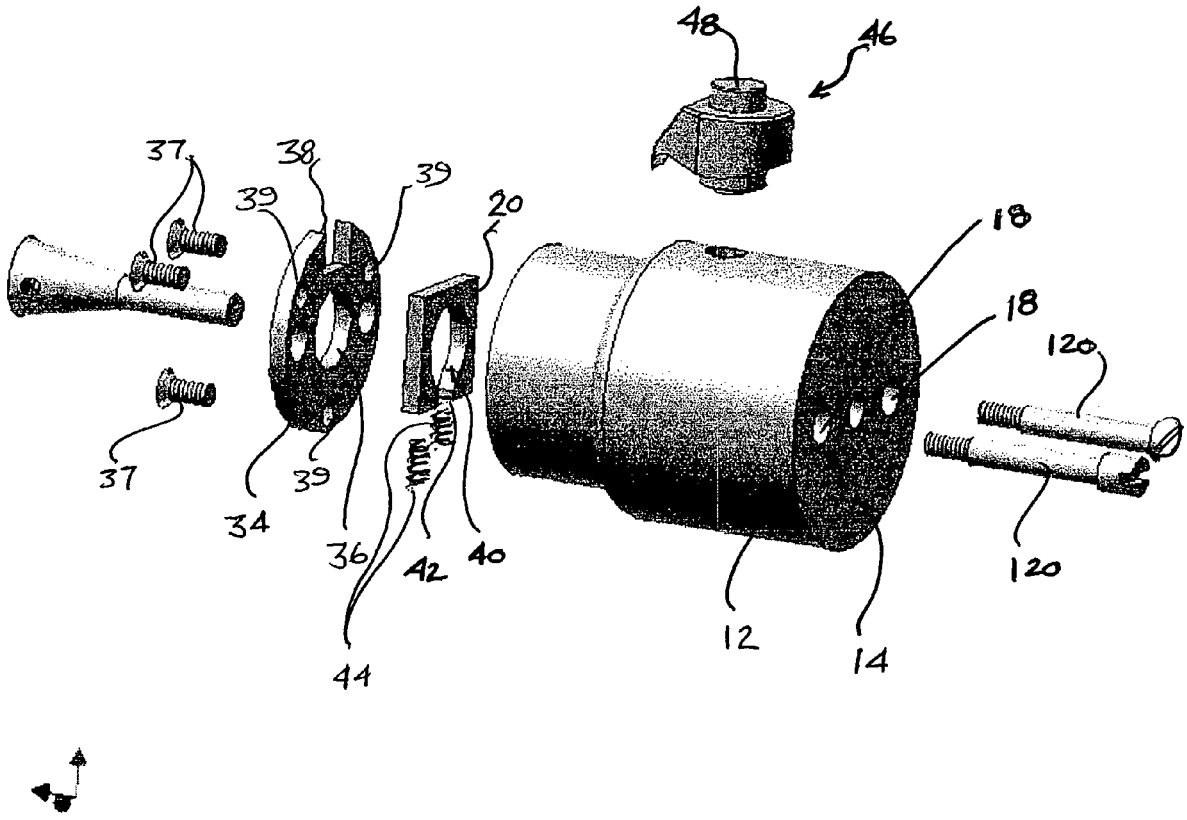
FIG. 3 is an exploded view of the housing of the present invention and illustrating the assembly of various of the components of that housing.

Taking FIG. 3, along with FIGS. 1 and 2, there is shown an exploded view of the housing 12 to illustrate the construction and assembly of the latch member 20 to the housing. Thus, there is a plate 34 that is shown as circular to fit within the interior of the housing 12 and which has a central plate opening 36 and a slot 38 formed at the outer peripheral edge of the plate 34. In assembling or affixing the latch member 20 to slide within the housing 12, therefore, the latch member 20 is located into the recess 22 and the plate 34 is affixed to the internal surface 24 of the housing 12 by means of screws 37 that pass through screw holes 39 in the plate 34 and are screwed into the threaded holes 28 in the interior surface 24 of the housing 12. By dimensioning the depth of the recess 22 to be several thousandths larger than the thickness of the latch member 20, the latch member 20 can be securely affixed to the housing 12 and yet be free to move radially with respect to the central axis of the conical shaped bore 26.

The latch member 20 can be seen in FIG. 3 to have a latch member opening 40 with a latch member slot 42 formed at the bottom thereof. In the construction of the present lock assembly 10, as stated, the latch member 20 can thus be seen to be radially slidable within the housing 12 with respect to the central axis of the conical shaped bore 26 and is movable between two positions, an aligned position where the center of the circular latch member opening 40 is in alignment with the central axis of the conical shaped bore 26 and an offset position where the center of the circular latch member opening 40 is misaligned with the central axis of the conical shaped bore 26. The latch member 20 is biased toward its offset or misaligned position by means of springs 44.

In order to move the latch member 20 into its aligned position, thereby moving against the bias exerted by the springs 44, there is a release mechanism that includes a pushbutton assembly 46 that is affixed to the housing 12.

Figure 4:
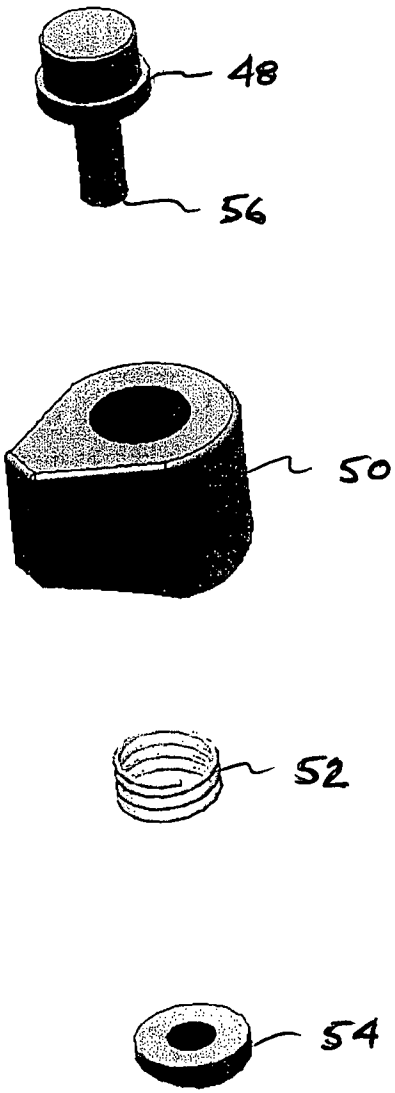
FIG. 4 is an exploded view of the pushbutton assembly that is used with the illustrated embodiment.

Turning to FIG. 4, there is shown some of the components of the pushbutton assembly 46 and which includes a pushbutton 48 that is located within a pushbutton housing 50 and the push button 48 is biased outwardly with respect to the pushbutton housing 50 by a pushbutton spring 52 that acts against the pushbutton 48 and a fixed pushbutton washer 54. As therefore can be seen, the pushbutton assembly is affixed to the housing 12 to be located at the hole 30 (FIG. 3) so that once so affixed, the distal end 56 of the pushbutton 48 extends through the wall of the housing 12 and into the rectangular recess 32 (FIG. 2).

Figure 5:
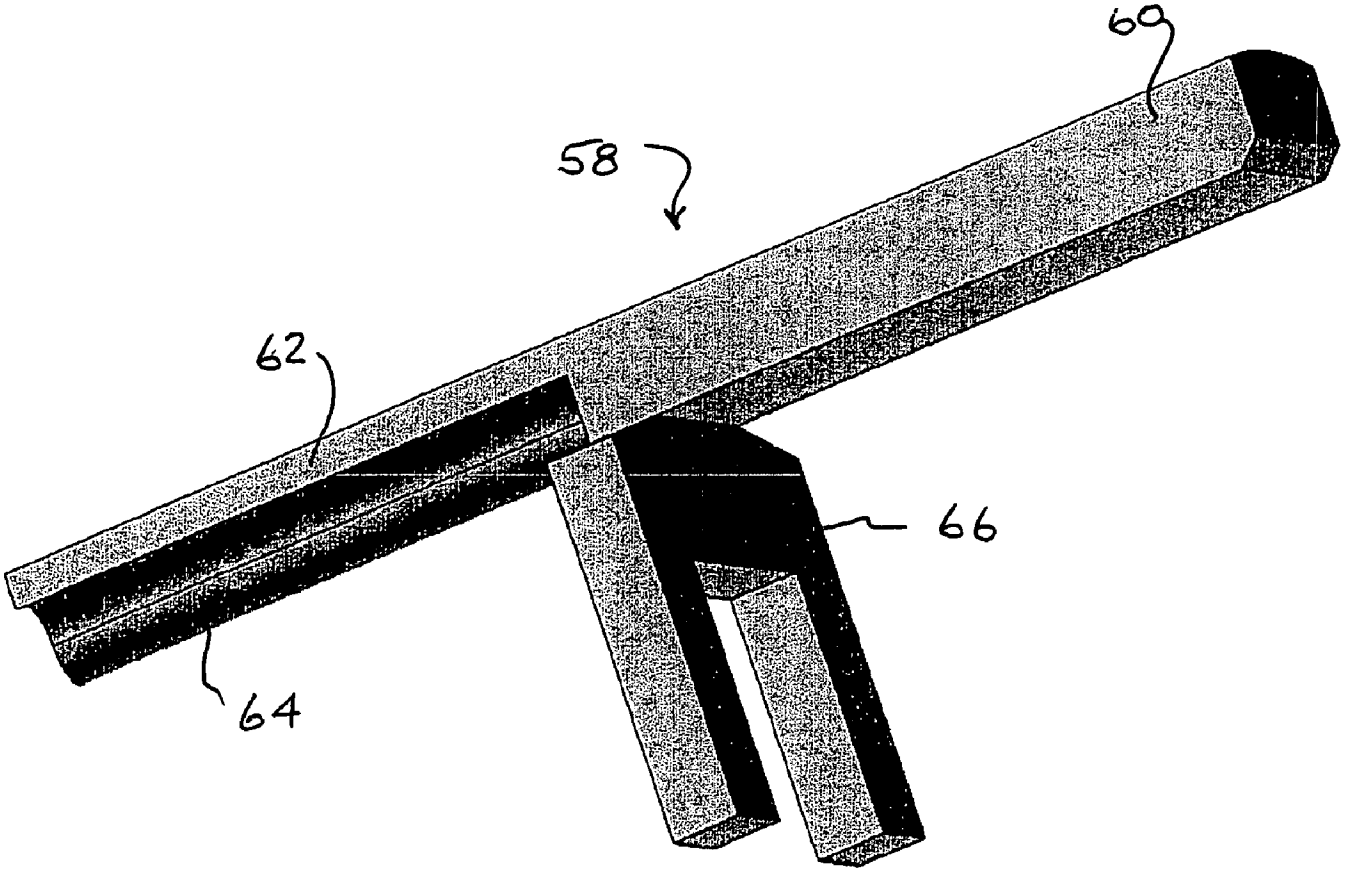
FIG. 5 is a perspective view of the T-bar of the present invention.

The release mechanism also includes a T-bar 58 that is best shown in the perspective view of FIG. 5, taken along with FIG. 1, and which has a forward portion 60 that is adapted to fit within the rectangular recess 32 in the housing 12 (FIG. 2) and be located intermediate the upper edge of the latch member 20 and the distal end 56 of the pushbutton 48. The T-bar 58 also has a rearward portion 62 that extends rearwardly and has a cross sectional configuration shaped as a T with a main leg 64 of the T-bar 58 extending downwardly.

There is a flange 66 that is located intermediate the forward portion 60 and the rearward portion 62 of the T-bar 58 and which also extends downwardly from the T-bar 58 and is configured in an inverted U shape.

Referring to FIG. 1, a tumbler barrel 68 is provided and to which the T-bar 58 is movable affixed and the manner of affixation is similar to the movable affixation of the latch member 20 to the housing 12 as described with respect to FIG. 2.

Figure 6:
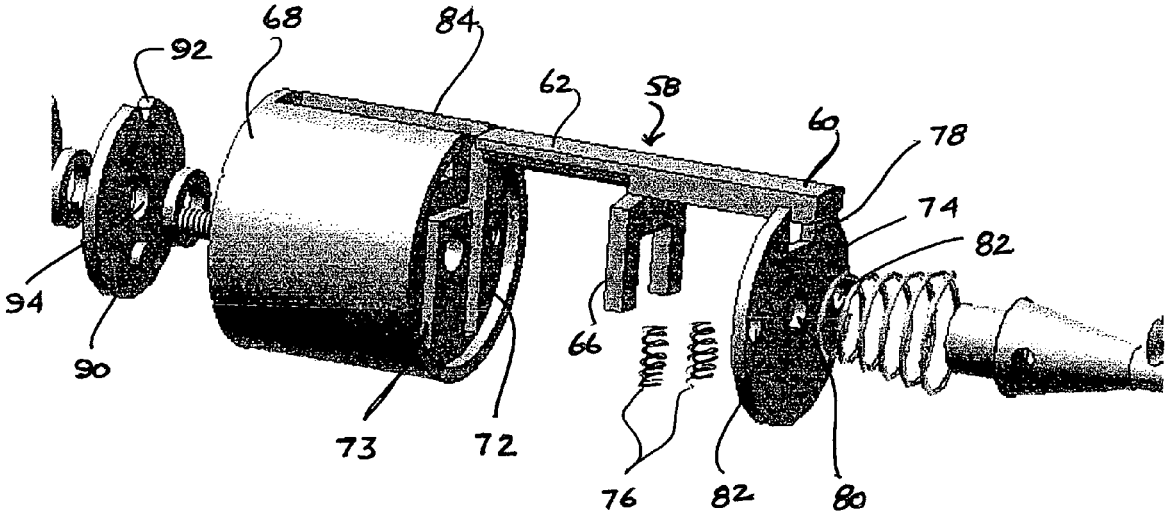
FIG. 6 is an exploded view of various components of the present lock assembly illustrating its construction.

As such, turning also to FIG. 6, taken along with FIG. 1, there is shown an exploded view to illustrate the assembly of the various components to the tumbler barrel 68 and, in particular, the affixation of the T-bar 58 thereto. Thus, there is an internal surface 72 of the tumbler barrel 68 on which there has been formed a recess 73 generally in the shape or complementary to the shape of the flange 66. The flange 66 therefore can be slidingly fitted into the recess 73 so as to be movable radially with respect to the tumbler barrel 68 and a plate 74 is fitted into the tumbler barrel 68 to retain the flange 66 within the recess 73. A pair of springs 76 act against the flange 66 to bias it to its radially outward position. The depth dimension of the recess 73 can be a few thousandths greater than the thickness of the flange 66 to insure that the flange 66 can move freely even after the plate 74 has been fitted into place covering the internal surface 72 of the tumbler barrel 68.

As is also shown, the plate 74 has a slot 78 within which the T-bar 58 rides as it moves between its extreme outward and inward positions. The plate 74 also has a central plate opening 80 and a pair of lateral plate holes 82 to serve a purpose that will be later explained.

To this point, therefore, the movement of the T-bar 58 can be described, that is, the T-bar 58 moves radially outwardly and inwardly with respect to the main axis of the tumbler barrel 68 and the housing 12 with the forward portion 60 of the T-bar 58 being located within the rectangular recess 32 in the housing 12 and the rearward portion 62 located in an elongated slot 84 formed in the tumbler barrel 68.

Referring to FIGS. 1–6, since the forward portion 60 of the T-bar 58 is located intermediate the distal end 56 of the pushbutton 48 and the upper edge of the latch member 20, as the pushbutton 48 is moved inwardly, that is, depressed by the user, T bar 58 is moved inwardly to, in turn, move the latch member 20 from its offset position to its aligned position. When the user thereafter releases the pushbutton 48, the spring bias exerted by the springs 44 and 76 tend to move the T-bar 58 outwardly to return the latch member 20 to its offset position.

There is, however, a locking assembly 86 that, at certain times, blocks the inward movement of the T-bar 58. That locking assembly 86 is best shown and described in the aforementioned U.S. Pat. Nos. 5,475,994 and 5,239,767 of Briley Jr. et al and includes a dial cap 88 that fits over the tumbler barrel 68 and can be rotated by the user with respect to the tumbler barrel 68.

As such, in accordance with the Briley Jr. et al patents, there are a plurality of lock tumblers 90 that are rotatably fitted with the tumble barrel 68 and each lock tumbler 90 can be rotated by means of the dial cap 88 to certain rotational positions. Each lock tumbler 90 has a notch 92 (best show in FIG. 6) located at its peripheral edge and a central hole 94. There are no numbers or other indicia relating to a combination marked on the dial cap 88; to the contrary, the dial cap 88 is rotated by the user in a predetermined coded sequence of rotational movements that eventually result in the aligning of all of the notches 92 in their uppermost positions. The sequence of those rotational movements of the dial cap 88 is sensed by a tactile system that allows a coded sequence to be entered by the user in a very secure manner and yet allows the user to readily enter the predetermined combination or sequence of rotational movements of the dial cap 88 to eventually result in the alignment of all of the notches 92 in the proper position.

Accordingly, when all of the notches 92 have been aligned, it is possible for the rearward portion 62 of the T-bar 58, in particular the main leg 64 thereof, to move inwardly through the elongated slot 84 in the tumbler barrel 68 such that the rearward portion 62 of the T-bar 58 can actually enter into the aligned notches 84 to allow the T-bar 58 to moved to its inward location. Taking, therefore, the overall action of the T-bar 58, as has been explained, the locking assembly 86 can be seen to have a blocked position where at least one of the lock tumblers 90 is misaligned with the other lock tumblers 90 such that the T-bar 58 is blocked from entering into the aligned arrangement of notches 92 in the lock tumblers 90 and a unblocked position where all of the lock tumblers 90 are in the proper alignment with all of the notches 92 aligned in their upper positions.

Figure 7:
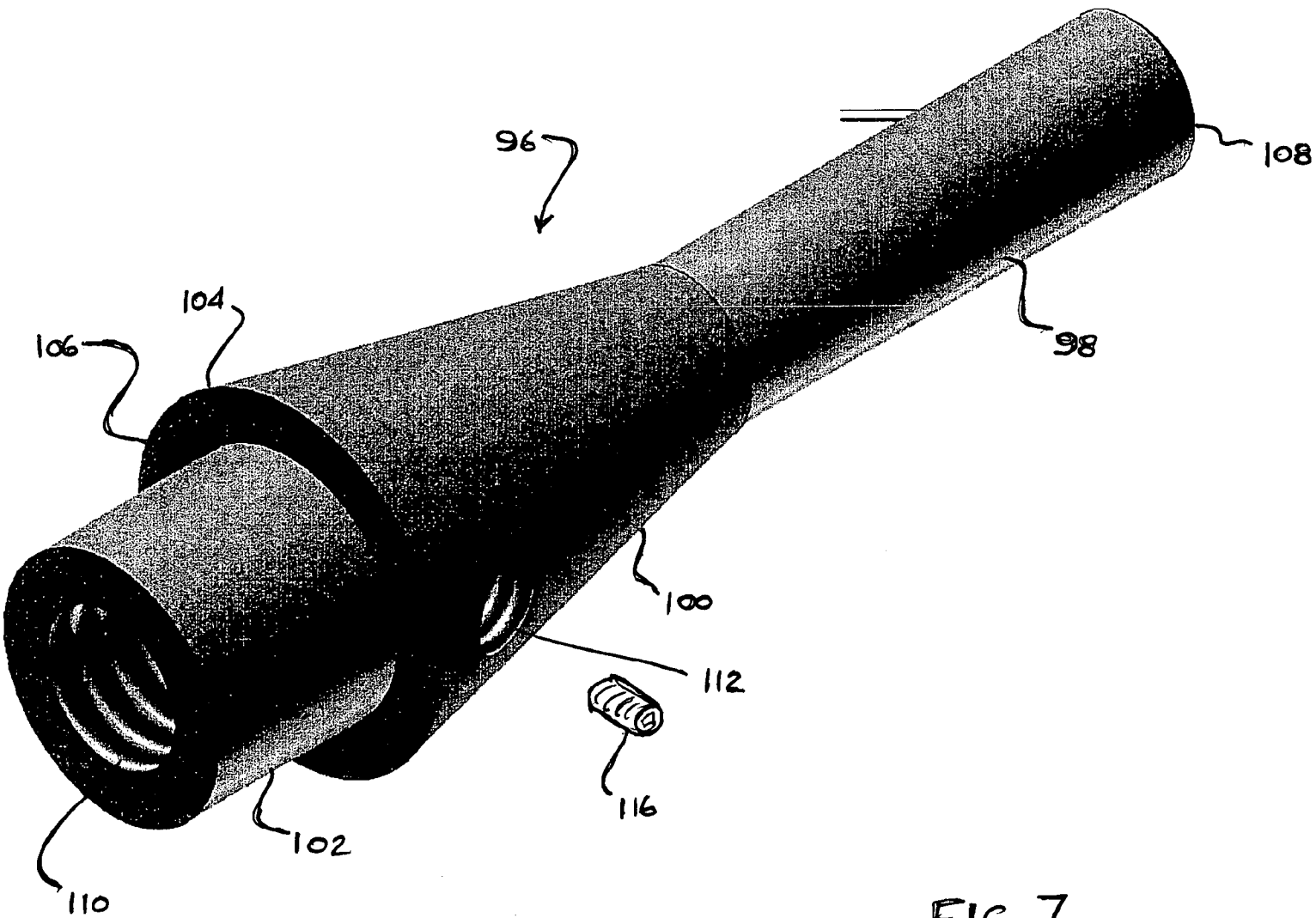
FIG. 7 is a perspective view of the push rod of the present invention.

Referring specifically FIG. 1, there is a push rod 96 located within the lock assembly 10 and which can also be seen in FIG. 7 as a perspective view of that component. Accordingly, in the embodiment shown the push rod 96 has a cylindrical shaped forward portion 98, an intermediate portion 100 that is generally conical in configuration and a rearward portion 102 that is generally cylindrical shaped.

Dimensionally, the forward portion 98 has an outer diameter that allows the forward portion to pass snugly through the central opening 16 in the front face 14 of the housing 12. The conical shaped intermediate portion 100 is configured to be a complementary shaped to conform and fit into the inner conical shape bore 26 in the housing 12. At the larger end 104 of the conical shaped intermediate portion 100, the diameter of that intermediate portion 100 is larger than the outer diameter of the cylindrical shaped rearward portion 102 such that a circumferential ridge 106 is formed at that junction of the intermediate portion 10 and the rearward portion 102.

In the embodiment illustrated, the circumferential ridge 106 is formed by the dissimilar diameters of the intermediate portion 100 and the rearward potion 102, however the circumferential ridge 106 could be formed in other configurations such as the presence of a circumferential slot formed in the external diameter of the push rod 96 or by other means, it only being of importance that there is a surface on the push rod 96 that faces away from the distal end 108 of the push rod 96.

The diameter of the larger end 104 of the conical shaped intermediate portion 100 of the push rod 96 is smaller than the diameter of the latch member opening 40 (FIG. 3) such that when the latch member opening 40 is in alignment with the larger end 104 of the intermediate portion 100, that is, the center of the circular latch member opening 40 is aligned with the main longitudinal axis of the push rod 96, the larger end 104 of the intermediate portion 10 can pass through the latch member opening 40 whereas, if the latch member opening 40 is offset from that aligned position, the inner peripheral edge of the latch member opening 40 will engage the circumferential ridge 106.

As is also shown in FIG. 7, there are female threads 110 formed in the rearward portion 102 of the push rod 96 and a threaded hole 112 located in the peripheral side of the intermediate portion 100.

The push rod 96 and the locking assembly 86 are basically affixed together and that assembly is carried out with the use of a bolt 114 that is inserted initially through the dial cap 88 and continued on through each of the central holes 94 in the lock tumblers 90 and threaded into the female threads 110 in the push rod 96. Once the proper tension has been achieved so as to allow the rotational movement of the dial cap 88, a set screw 116 is inserted and tightened into the threaded hole 112 (FIG. 7) to affix the push rod 96 to the bolt 114 to hold the push rod 96 as well as the entire locking assembly 86 together as a unit.

That assembly, that is, the locking assembly 86 as well as the push rod 96 and T-bar 58 are, therefore, movable longitudinally with respect to the main longitudinal axis of the push rod 96 between a locked position wherein the distal end 108 of the push rod 96 extends out from the front face 14 of the housing 12 and an unlocked position, in the embodiment shown, where the push rod 96 is retracted back into the housing 12. It can be seen, however, that only some retracting movement may be necessary with some locking environments where the distal end 108 has an locked, extended position and the unlocked, retracted position only retracts the distal end 108 a short distance such that the distal end 108 may not necessarily become withdrawn into the housing 12.

A spring 118 is also provided that has one end thereof seating against the plate 34 and the other end seating against the plate 74. The spring 118 is normally in compression and therefore creates a bias tending to move the assembly including the locking assembly 86, push rod 96 and T-bar 58 outwardly toward the unlocked position. That movement of the push rod 96 and other named components is facilitated by riding on a pair of rails 120 that are inserted through the lateral openings 18 in the front face 14 of the housing 12 and are movable secured within the tumbler barrel 68.

As such, the overall operation of the present lock assembly can now be explained. While the movement of the push rod 96 will be referred to as moving between a locked and an unlocked position, it will be understood that as the push rod 96 moves, so does the locking assembly 86 and the T-bar 58.

Accordingly, taking FIGS. 1–7, basically the push rod 96 moves between a locked position where the distal end 108 of the push rod 96 extends outwardly from the front face 14 of the housing 12 and an unlocked position where the push rod 96 is retracted at least partially rearwardly into the housing 12 from that extended, locked position. Taking, therefore, the movement of the push rod 96 from the locked position to the unlocked position, in the locked position, the distal end 108 of push rod 96 is extended to its furthest position outwardly from the front face 14 of the housing 12. The push rod 96 is held in that locked position by means of the latch member 20 that is radially positioned with respect to the circumferential ridge 106 in its offset portion, that is, the latch member opening 40 is not aligned with the central longitudinal axis of the push rod 96 and therefore the latch member opening 40 is not aligned with the larger end 104 of the intermediate portion 100. Thus while the spring 118 is trying to move the push rod 96 back to its unlocked position, that movement is prevented since the circumferential ridge 106 abuts again the inner peripheral surface surrounding the latch member opening 40. At this point, the lock assembly is locked i.e. the push rod 96 is in its extended, locked position.

In order to move the push rod 96 to its unlocked position, it is necessary to depress the pushbutton 48 which bears against the forward portion 60 of the T-bar 58 in order to push that T-bar 58 inwardly so as to also move the latch member 20 from its offset position to its aligned position where the latch member opening 40 is in alignment with the push rod 96 and thus the larger end 104 of the push rod 96 can pass through the latch member opening 40. Thus, the bias exerted by the spring 118 urging the push rod 96 toward its unlocked position can bring about that movement and the push rod 96 can move to its unlocked position.

However, the movement of the push button 48 can only take place if the locking assembly 86 is in its unblocked position. As can be appreciated, the pushbutton 48 cannot displace the T-bar 58 inwardly unless the T-bar 58 is free to move inwardly and that inward movement can be blocked by at least one of the lock tumblers 90 being misaligned with the other lock tumblers 90 with the notches 92 in the uppermost positions. Thus, before the lock assembly 86 can be unlocked and the push rod 96 moved to its unlocked position, the user must carry out the predetermined, unlocking sequence of rotational movements of the dial cap 88.

As can now be seen, in order to unlock the present lock assembly 10, the user must enter the proper sequence of rotational movements into the dial cap 88 in order to locate all of the notches 92 of the lock tumblers 90 in an aligned upper location. Once that has been accomplished, the user can simply press inwardly on the pushbutton 48 to move the T-bar 58, that is no longer blocked by the locking assembly 86, inwardly to, in turn, move the latch member 20 from its offset position to its aligned position to allow the larger end 104 of the intermediate portion 100 to become aligned with the latch member opening 40 so that the larger end 104 can pass therethrough and the push rod 96 moved to the unlocked position. Once unlocked, the use can release the pushbutton 48 and the pushbutton spring 52 will return it to its original undepressed position.

In order to relock the lock assembly 10, the user pushes inwardly on the dial cap 88 in order to push the push rod 96 forwardly so that the latch member 20 encounters and then progressively slides downwardly along the conical shaped intermediate portion 100 of the push rod 96 until the latch member 20 clears the larger end 104 of the intermediate portion 100 whereupon the spring 44 pushes the latch member 20 upwardly to encounter the rearward portion 102 of the push rod 96 that is of a lesser diameter and the latch member 20 is held in the position by springs 44. The push rod 96 is then also prevented from moving to its unlocked position since the circumferential ridge 106 bears against the inner peripheral edge of the latch member opening 40 with the latch member 20 now being in its offset position so that the push rod 96 is retained in the locked position.

Figure 8:
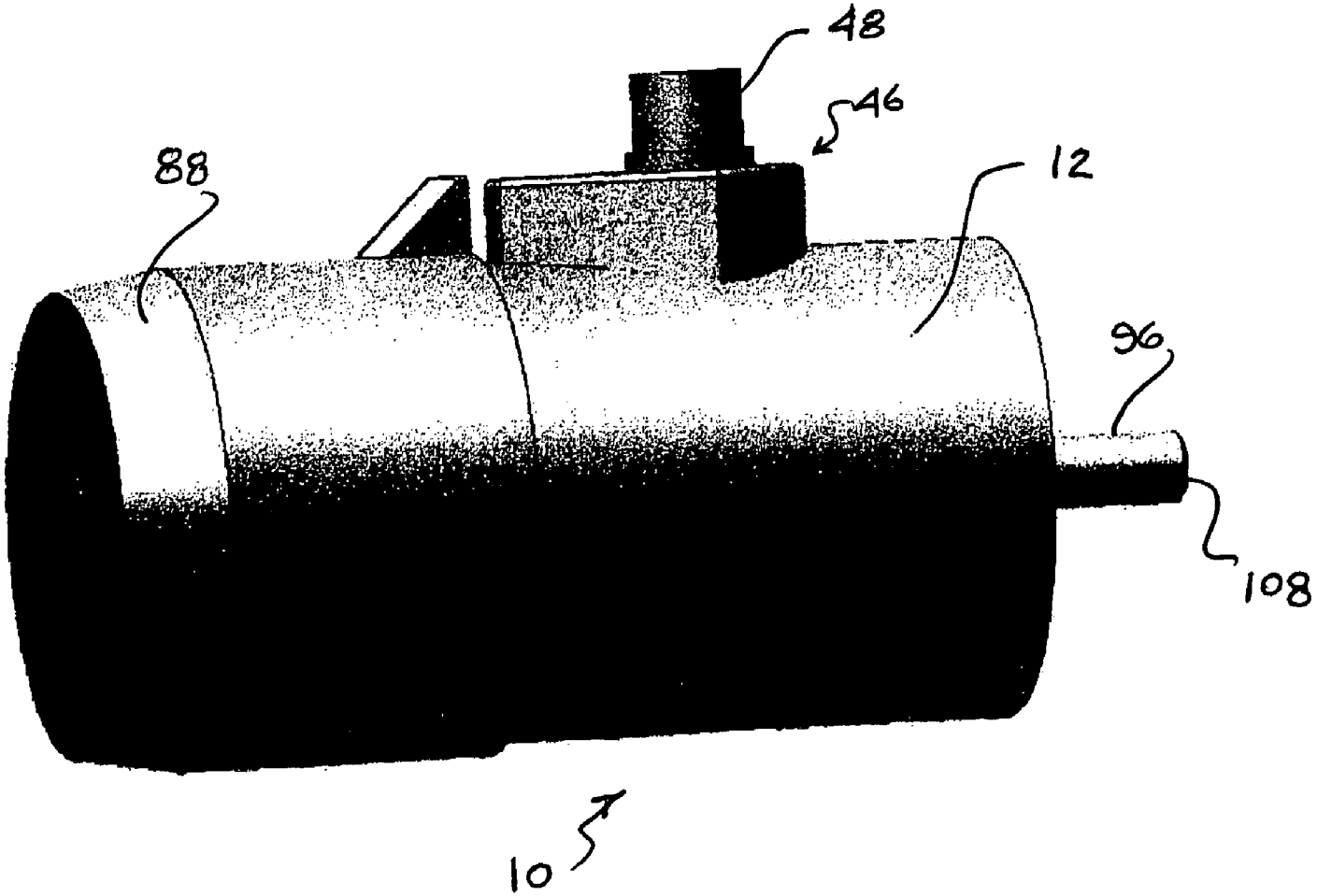
FIG. 8 is a perspective view of the overall, assembled lock assembly shown in its locked position.

Turning now to FIG. 8, there is shown a perspective view of a lock assembly 10 of the present invention shown in its locked position. In FIG. 8, it can be seen that the dimensions are such that the housing 12 forms a smooth outer surface with the dial cap 88 in a close relationship with little room to interpose a pry bar to attempt to thwart the purpose of the locking assembly 10. In addition, the overall appearance of the lock assembly is esthetically pleasing and is therefore usable in most any environment. Additionally, the components of the lock assembly 10 are mainly manufacturable under conditions of mass production molded products and therefore at a very attractive cost structure out of strong, high impact resistant plastic materials.

Figure 8A:
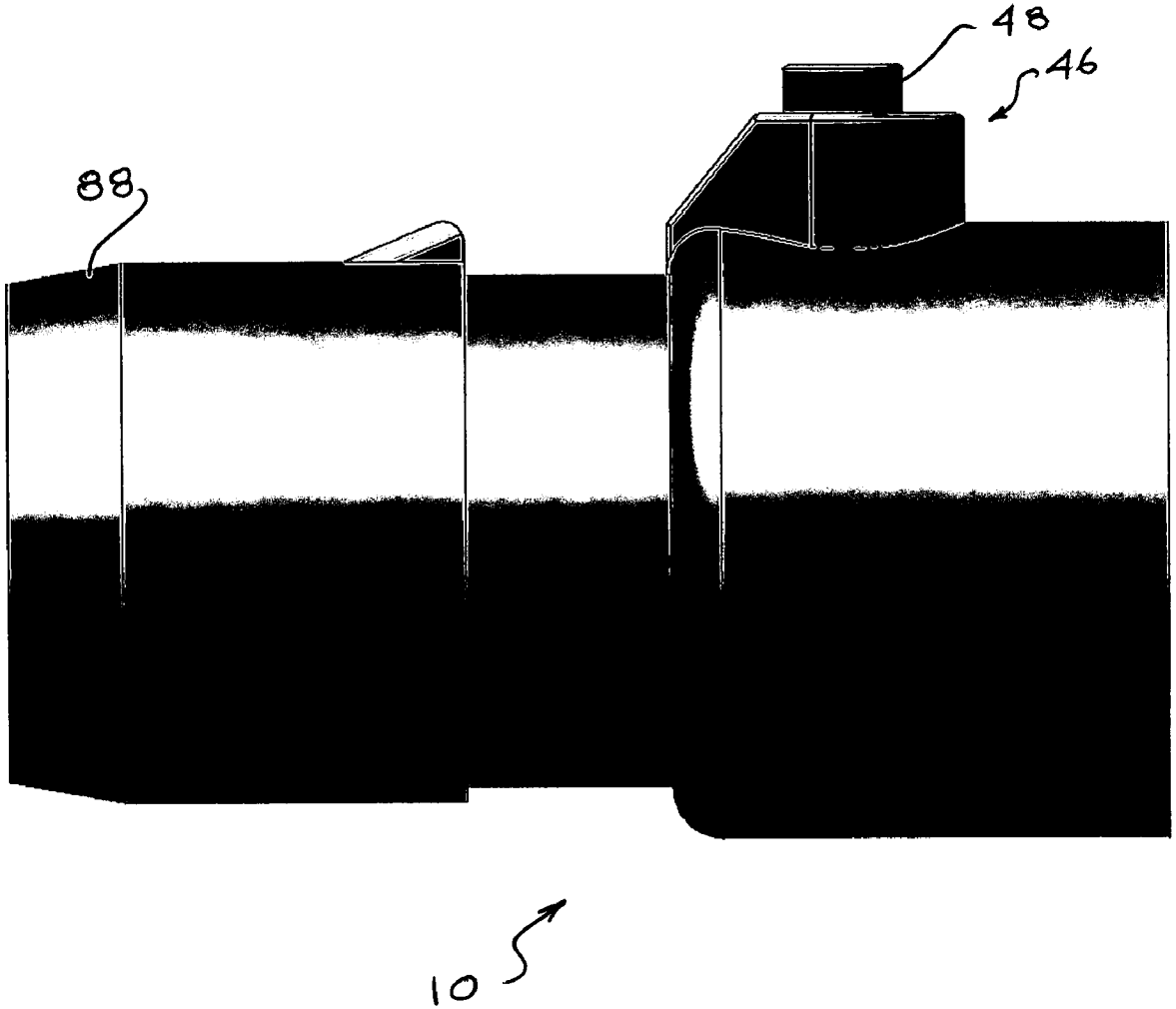
FIG. 8A is a perspective view of the overall, assembled lock assembly shown in its unlocked position.

Turning now to FIG. 8, there is shown a perspective view of a lock assembly 10 of the present invention shown in its unlocked position. In FIG. 8A, it can be that the dial cap 88 has been displaced away from the housing 12 and also that the push rod 96 (FIG. 8) has been moved to a position where it has been withdrawn into the housing 12.

Figure 9A:
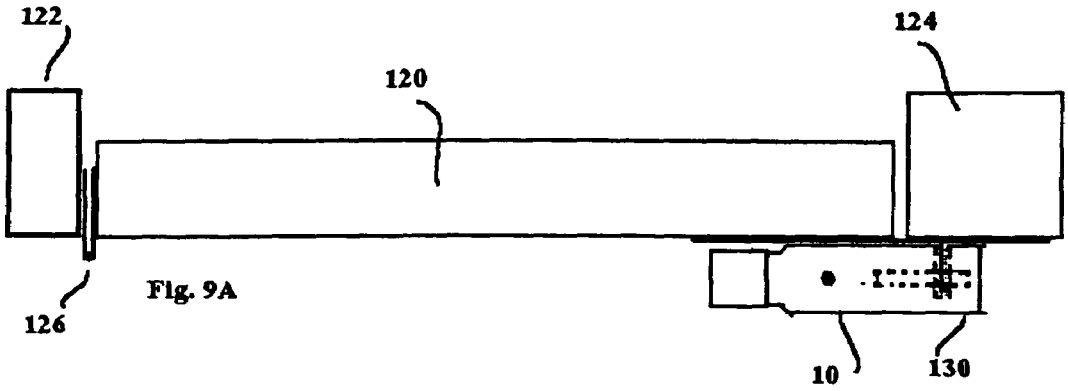
FIGS. 9A and 9B are schematic views of a locking system utilizing the present lock assembly.
Figure 9B:
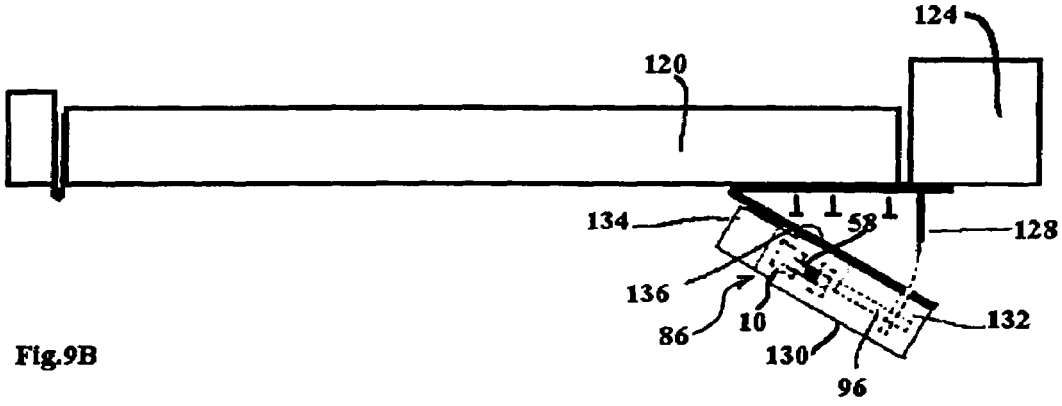

Turning now to FIGS. 9A and 9B, there are shown schematic views of a locking system utilizing the lock assembly 10 as shown and described in FIGS. 1–8 in order to illustrate some of the uses of that lock assembly 10. Accordingly, in FIGS. 9A and 9B, there is a lock assembly 10 that employs additional lock hardware in order to secure a swinging gate 120. Thus, there are a pair of gate posts 122 and 124 with the swinging gate 120 being affixed to the gate post 122 by means of a hinge 126 and a hasp 128 extending outwardly from the gate post 124.

The lock assembly 10 includes the components heretofore described including a locking assembly 86, T-bar 58 and push rod 96 and which operate as described with the push rod 96 being movable between its fully extended, locked position and a retracted position. In this embodiment of a locking system, the movement of the push rod 96 between its locked and unlocked positions can take place fully contained within the extended housing 130 that has a rectangular slot 132 formed therein facing the hasp 128. The lock assembly 10 is affixed to the swinging gate by a hinged set of straps 134, 136, preferably constructed of steel. Strap 134 is affixed to the swinging gate 120 and strap 136 is affixed to the lock assembly 10.

As such, the strap 136 allows the lock assembly 10 to be pivotally mounted to the swinging gate 120 such when the swinging gate 120 is closed, as shown FIGS. 9A and 9*b*, the strap 136 can be pivoted to the position shown in FIG. 9A where it abuts against the swinging gate 120 and the hasp 128 enters the rectangular slot 132. As such, as the dial cap 88 is pushed inwardly, the push rod 96 is moved outwardly to its extended, locked position so as to pass through the hasp 128 and securely lock the swinging gate 120 to the gate post 124.

As can be seen, the hasp 128 is captured within the rectangular slot 132 of the extended housing 130 so that it is not readily accessible to one trying to break into the gated area and the mounting screws to secure the steel straps 134, 136 are trapped behind the straps 134, 136 for protection, thereby making the overall lock system very difficult to violate. In addition, of course, the locking system is keyless and can be manipulated in the dark.

Figure 10A:
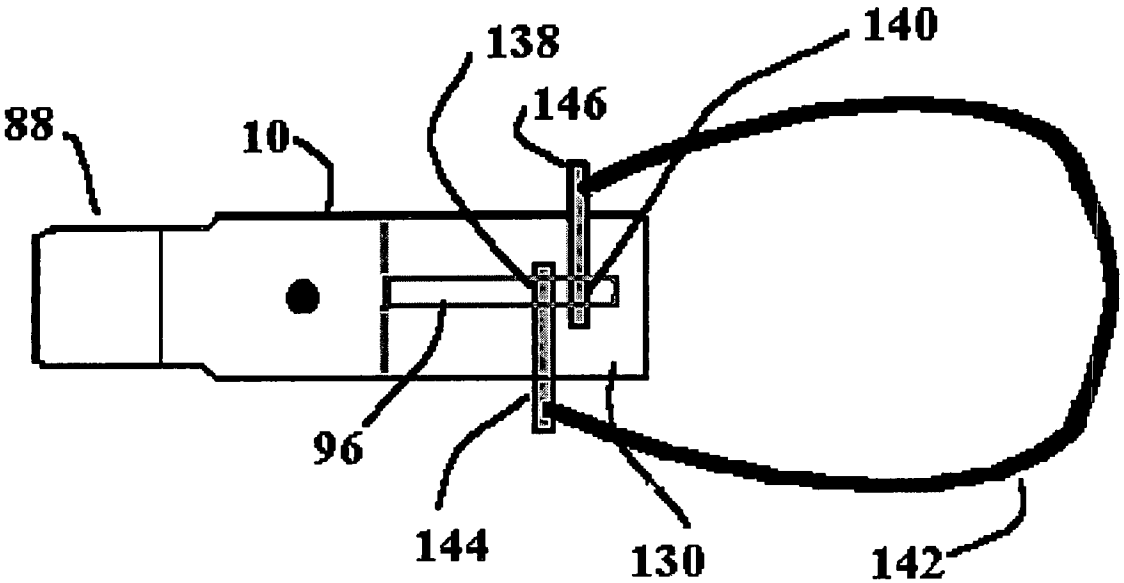
FIGS. 10A and 10B are schematic views of an alternative locking system utilizing the present lock assembly.
Figure 10B:
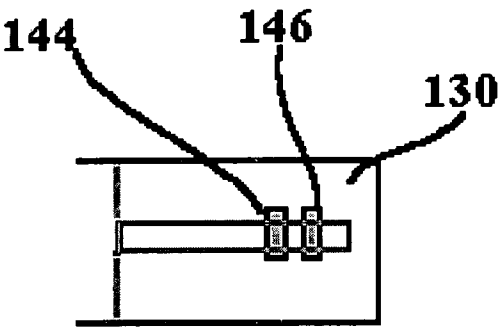

Turning next to FIGS. 10A and 10B, there is shown a schematic view of a further locking system utilizing the lock assembly 10 of the present invention and with the same components given like numbers as with the prior embodiment. In this embodiment, however, there are two rectangular slots 138, 140 that are displaced angularly around the extended housing 130. In FIG. 10A, the rectangular slots 138, 140 are shown to be 180 degrees apart, however, other angular separations can be utilized or, as a still alternative embodiment, one extra wide rectangular slot could be utilized.

In any event, in this embodiment there is a flexible chain or cable 142 having a hasp 144, 146 at each end thereof such that the hasps 144, 146 can be inserted into the rectangular slots 138, 140 and, again as the dial cap 88 is pushed inwardly, the push rod 96 is moved outwardly to its extended, locked position so as to pass through both of the hasps 144, 146 and securely lock both ends of the cable 142 together within the extended housing 130. As also can be appreciated, one of the ends of the cable 142 can be permanently affixed to the extended housing 130 and the other free end have a hasp affixed thereto.

As with the prior embodiment, it can be seen that there is no mounting hardware readily accessible to a potential abuser and the hasps 144, 146 are well protected and therefore the overall lock system is very difficult to be violated.

Figure 11A:
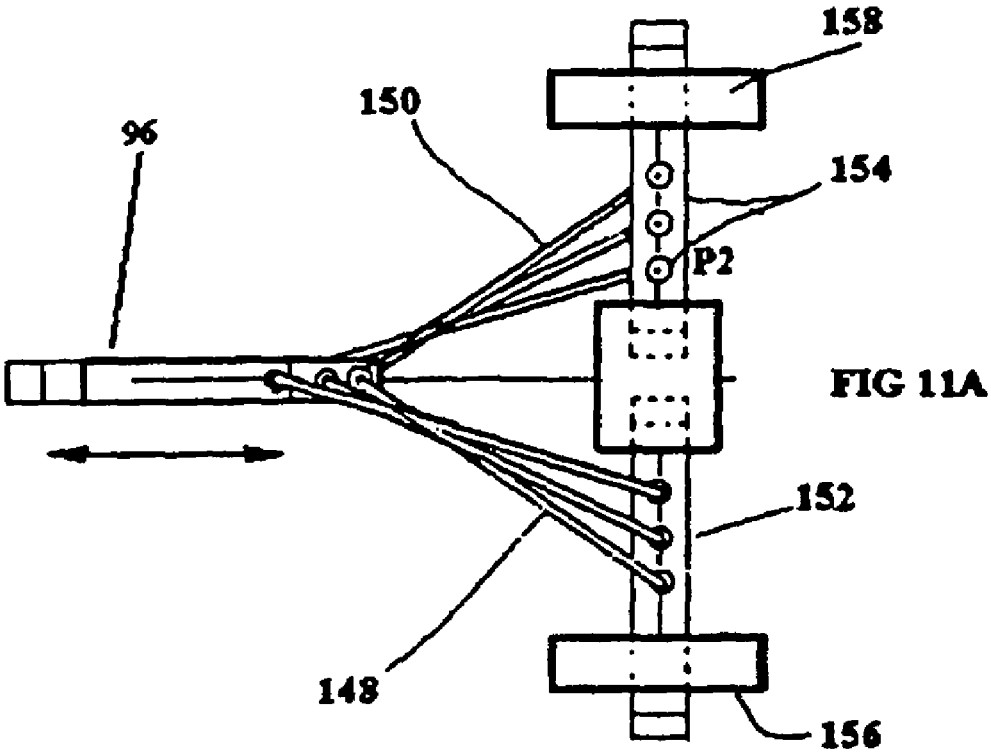
FIGS. 11A and 11B are schematic views of a still further alternative locking system utilizing the present lock assembly.
Figure 11B:
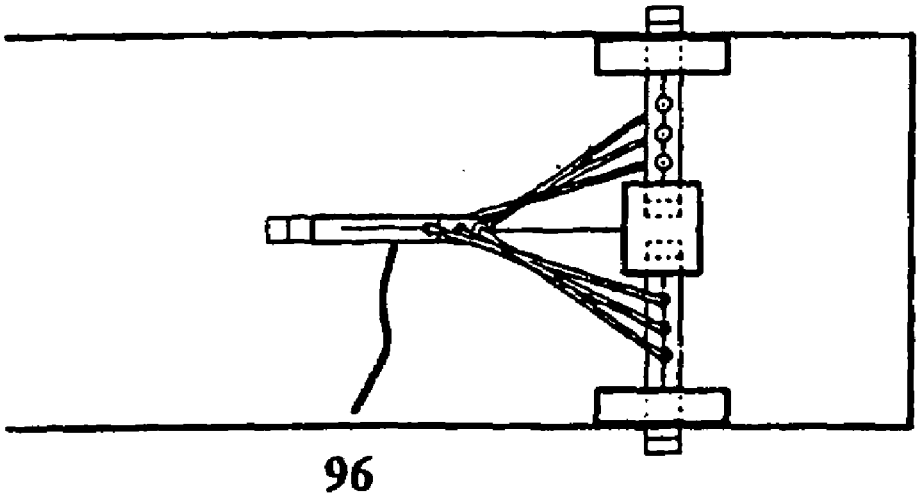

Turning next to FIGS. 11A and 11B, there are schematic views of a still further lock system that uses the lock assembly of the present invention. In this embodiment, the push rod 96 connects to a pair of rigid links 148 150 that, in turn, connect to a pair of cross rods 152,154 that ride in bearing cells 156, 158 such that moving the push rod 96 in, or example, a horizontal direction can transfer that motion 90 degrees to the cross rods 152, 154 that move at a right angle to the motion of the push rod 96. As such the embodiment can be used to convert the motion of the push rod 96 to motion at a right angle thereto and can be used as a door lock or to a mounting device that is inserted into a hollow opening in a structure and the cross rods can hold the locked device to the opening.

Obviously, the aforementioned lock systems are but examples of the versatile nature of the present locking mechanism and there are many others uses of the present lock mechanism that can be envisioned with departing from the intent and spirit of the present invention.

Those skilled in the art will readily recognize numerous adaptations and modifications which can be made to the lock assembly and method of using the same of the present invention which will result in an improved apparatus and method, yet all of which will fall within the scope and spirit of the present invention as defined in the following claims. Accordingly, the invention is to be limited only by the following claims and their equivalents.

What is claimed is:

1. A lock assembly, said lock assembly comprising:

a housing;

a push rod having a longitudinal axis, said push rod being movably mounted within the housing along said longitudinal axis between a locked position wherein the push rod extends outwardly from the housing and an unlocked position wherein the push rod is positioned substantially within the housing, said push rod being biased toward the unlocked position, said push rod having a circumferential ridge formed thereon, a latch member having a opening having a configuration generally in the shape and dimensionally larger that said circumferential ridge, said latch member being mounted in said housing for radial movement with respect to said longitudinal axis of said push rod between a first position where the opening is aligned with the circumferential ridge and thus allows the circumferential ridge to pass through the opening to allow the push rod to move from its locked position to its unlocked position and a second position where the opening is offset with respect to said circumferential ridge such that the latch member contacts the circumferential ridge to prevent said push rod from moving from its locked position to its unlocked position, said latch member being biased toward said second position, a release mechanism mounted to said housing and engageable by a user to move said latch member from said second position to said first position, a locking mechanism adapted to be activated by a user, said locking mechanism having a blocked position wherein the locking mechanism blocks the latch mechanism from moving the latch member and an unblocked position wherein the release mechanism is free to be moved by a user to move the latch member from its second position to its first position.

2. The lock assembly as defined in claim 1 wherein said locking mechanism comprises a plurality of lock tumblers that must be aligned by a user to place the locking assembly in said unblocked position.

3. The lock assembly as defined in claim 1 wherein each of said locking tumblers has a notch formed therein and wherein said lock tumblers are in alignment when all of said notches are in alignment.

4. The lock assembly as defined in claim 3 wherein said release mechanism includes a locking bar and an external pushbutton, wherein said locking bar is movable by said external pushbutton to move said locking bar from said second position to said first position where said locking bar enters into said aligned notches to allow movement of said release member to move said latch member from said second position to said first position.

5. The lock assembly as defined in claim 1 wherein the circumferential ridge is a shoulder formed in the exterior of the push rod.

6. The lock assembly as defined in claim 1 wherein said release member is a pushbutton mounted to the housing contacting the locking bar.

7. A method for operating a lock assembly, said method comprising the steps of:

providing a housing having a push rod that has a large diameter area, said push rod being movable between a locked position wherein the push rod extends outwardly from that housing and an unlocked position wherein the push rod is retracted from said locked position, providing a latch member having an opening, said latch member being movable between a first position wherein said opening in said latch member is aligned with said opening to allow the larger diameter to pass through said opening to enable said push rod to move from said locked position to said unlocked position and a second position wherein said opening is offset with respect to said large diameter area to prevent said push rod from moving to its unlocked position, providing a release mechanism to move said latch member from said second position to said first position, providing a locking mechanism having a blocked position that prevents the release mechanism from moving the latch member from said second position to said first position, said locking mechanism being manipulatable by a user to an unblocked position wherein the release mechanism is enabled to move said latch member from said second position to said first position, activating the release mechanism to move the latch member to said first position when the locking mechanism is in said unblocked position to cause the movement of the push rod from its locked position to its unlocked position.

8. The method of claim 7 wherein the step of providing a push rod comprises providing a push rod that is biased toward its unlocked position.

9. The method of claim 7 wherein the step of providing a latch member comprises providing a latch member that is biased toward its second position.

10. The method of claim 7 wherein the step of providing a locking mechanism comprises providing a tactile locking system.

11. The method of claim 7 wherein the step of providing a release mechanism comprises providing a pushbutton assembly that is affixed to the housing and includes a pushbutton having an outward position and an inward position, said pushbutton being biased toward said outward position.

12. The method of claim 7 wherein the step of providing a latch member comprise providing a latch member having a general conical portion with said large diameter area being the largest end of the conical portion.

13. A locking system using the lock assembly of claim 1 wherein said system further comprises lock hardware operatively associated with the lock assembly.

14. The locking assembly as defined in claim 13 wherein the lock hardware comprises an extended housing having a bore within which the push rod moves and said extended housing has at least one opening that crosses said bore, and a flexible cable having one end affixed to said extended housing and having a hasp at the free end thereof, said hasp being insertable into said at least one opening to be locked therein by said push rod as it moves from its unlocked position to its locked position.

15. The locking assembly as defined in claim 14 wherein said at least one opening comprise a pair of openings and said cable has a hasp at both ends thereof, each of said hasps being insertable into one of said pair of openings.

16. The locking assembly as defined in claim 13 for use on a swinging door having a free end mating with a post wherein said lock hardware is adapted comprises a pair of straps pivotally affixed together, one of said straps being affixed to said swinging door and the other of said straps being affixed to said lock assembly, said post having a hasp extending outwardly therefrom and a slot formed in said extended housing the receives said hasp when said door is in a closed position abutting against said post.

17. The locking assembly as defined in claim 13 wherein the locking hardware comprises at least one cross rod that is movable affixed in a bearing cell, and a rigid link that pivotally connects said push rod with said at least one cross rod, said rigid link converting the motion of said push rod in a first direction to the motion of the at least one cross rod in a second direction at an angle with respect to said first direction.

18. The locking assembly as defined in claim 13 wherein the first direction and the second direction are at an angle of about 90 degrees.

19. The locking assembly as defined in claim 17 wherein the at least one cross rod comprises two cross rods generally coaxial to each other and movable in opposite directions.

* * * * *